US005276310A

United States Patent [19]

Schmidt et al.

[11] Patent Number: 5,276,310

[45] Date of Patent: Jan. 4, 1994

[54] ELECTRICALLY HEATED TOOLBOX

[76] Inventors: William Schmidt, 21000 Woodruff Rd., Rockwood, Mich. 48173; Kirk Malcomson, 25287 E. Huron River Dr., Flat Rock, Mich. 48134

[21] Appl. No.: 843,510

[22] Filed: Feb. 28, 1992

[51] Int. Cl.[5] ..... H05B 3/06; F24C 7/10; F27D 11/00

[52] U.S. Cl. ..... 219/521; 219/386

[58] Field of Search ..... 219/385, 386, 387, 521, 219/407, 408

[56] References Cited

U.S. PATENT DOCUMENTS

| | | | |
|---|---|---|---|
| 2,885,526 | 5/1959 | Paulding | 219/394 |
| 2,919,339 | 12/1959 | Hilliker | 219/386 |
| 3,038,986 | 6/1962 | Molitor | 219/387 |
| 3,412,234 | 11/1968 | Otavka | 219/407 |
| 4,068,115 | 1/1978 | Mack | 219/386 |
| 4,092,138 | 5/1978 | Beitner | 219/521 |
| 4,140,893 | 2/1979 | Renteria | 219/385 |
| 4,580,035 | 4/1986 | Luscher | 219/385 |

*Primary Examiner*—Bruce A. Reynolds
*Assistant Examiner*—Michael D. Switzer
*Attorney, Agent, or Firm*—Weintraub, DuRoss & Brady

[57] ABSTRACT

An electrically heated toolbox for heating hand tools that have been stored or used in a cold environment. The toolbox is a multiple drawer container which has installed therein heating sheets integrally connected to an outside electrical power source, alternating current (AC) or direct current (DC). The heating sheets warm the hand tools by radiated heat or direct heat when the heating sheets are connected to the outside power source. A desired temperature may be obtained by using the rheostat temperature setting device. The toolbox may be connected to a standard AC plug connection, a DC vehicle battery or, if desired, a cigarette lighter outlet of a vehicle.

7 Claims, 2 Drawing Sheets

FIG 3
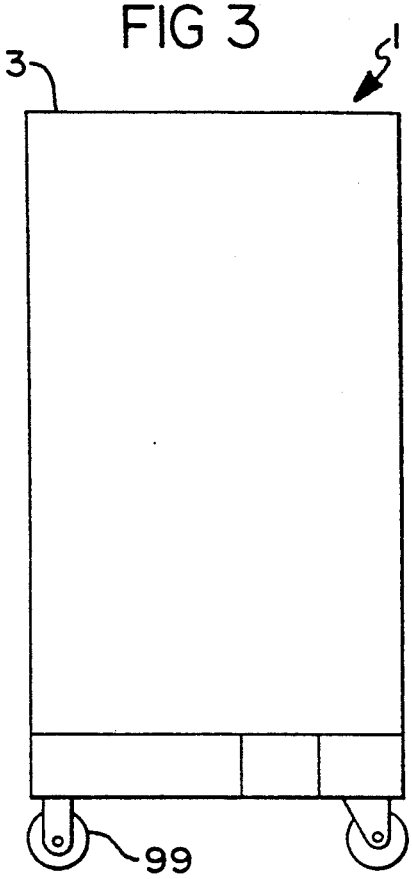
FIG 4
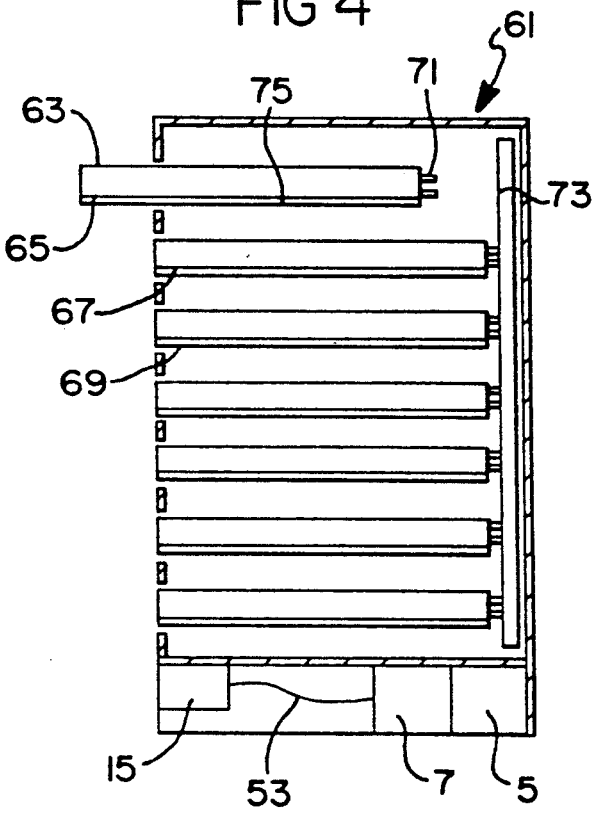
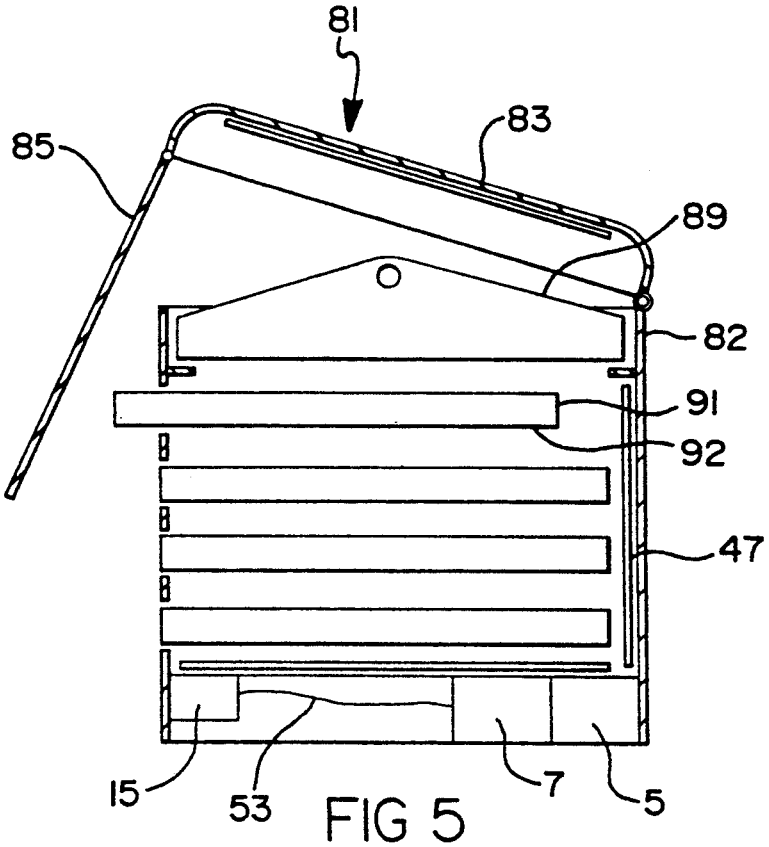
FIG 5

ELECTRICALLY HEATED TOOLBOX

BACKGROUND OF THE INVENTION

1. Field of the Invention

This invention relates to devices for heating tools. More particularly, this invention relates to heated containers for tools. Even more particularly, this invention relates to electrically heated containers for hand tools.

2. Description of the Prior Art

A heated tool container or box for warming tools used by an individual engaged in outdoor construction or equipment service work is quite useful. This is especially true in climates where the weather is cold for at least a portion of the year. Toolboxes for hand tools are commonly stored in unheated structures or on unheated service vehicles. Often, construction and service work require using unheated tools without the protections of gloves. Under these circumstances, a heated hand tool would greatly increase the ability of an individual to perform the required service.

Heated containers for warming an unheated item or preserving the warmth of heated items have been long known, such as heated food containers or the like.

These heated containers are provided with electrical heating devices that assist in retaining the heat for previously heated food. Typically, as may be seen from U.S. Pat. No. 2,543,524 and 5,816,646, an electric heating device is placed within the container. The heating device is connected to a source of electricity while in use. Similarly, heated lunch boxes are detailed in U.S. Pat. Nos. 3,602,691 and 3,808,401.

Each of the above references uses conventional heating wires or coils to provide heat within the containers. However, to accommodate heating wires or coils, a relatively bulky heating device is required.

In U.S. Pat. No. 3,371,975 there is disclosed a device for cooling an electrical powered hand tool. The device is a container equipped with an electrically powered cooling fan. However, the device is not capable of handling more than one tool at a time without becoming too large and cumbersome to be freely handled. Also, the device does not address the issue of heating a tool or heating a large number of tools.

Therefore, it would be desirable to provide an electrically heated toolbox which heats a large number of hand tools commonly stored or used by construction and outside service personnel in unheated environments. Also, it would be desirable to provide an electrically heated toolbox which can be powered by a common vehicle battery or by a standard electrical outlet.

The electrically heated toolbox of the instant invention is designed to address the above areas of concern.

SUMMARY OF THE INVENTION

The instant invention provides a heated toolbox for hand tools, comprising:

(a) a container for holding at least one tool; and (b) means for electrically heating the inside environment of the container such that at least one tool disposed within the container is heated to a predetermined temperature.

The preferred toolbox has a solid top and wall, a solid bottom wall, as well as solid side walls and a solid back wall. The front wall has multiple, elongated, rectangular apertures formed therein each for receiving a drawer or container for a hand tool.

The toolbox includes an electrically operated heating device installed within the tool container to heat the tools stored therein. The electrical power to heat the heating device is obtained from an outside source such as a vehicle battery, direct current or a standard electrical 110 or 220 volt alternating current outlet. The alternating current power is converted to direct current within the toolbox before it is used by the heating devices.

The heating device employed therein is a thin sheet of glass, ceramic or the like which is coated with Indium Tin Oxide (ITO). The ITO is applied to the ceramic in a thin film and serves as the conducting device that heats the inside of the toolbox. The ITO film is connected to a heating sheet bus which in turn is connected to a common bus fixed to the toolbox. The sheets are removably attachable to the two side walls, the back wall, the top and bottom surfaces of the tool container. The heat generates from the heating device radiates around the drawers heating the tools.

The temperature of the heating device may be regulated by a rheostat, or the like, which is connected to the electrical system between the voltage regulator and the common bus. The rheostat is used to set desired heating temperatures for the tools.

A second embodiment of the instant invention has the heating device attached to the bottom of the drawers instead of the side walls, top wall and bottom wall. The heating sheets are removably attached to the bottom surface of each drawer and the heat is directly applied to the tools instead of radiating from the toolbox sides, top and bottom.

A third embodiment of the instant invention is a toolbox with the top lid open to expose a stationary tray for tools. Tool drawers are installed below the stationary tray. In this embodiment, either the radiating heat or the direct heat to warm tools may be used. In the embodiment, the toolbox may also have a removable solid wall which is removably fitted to the front of the drawers when the toolbox is closed.

The toolbox hereof may be fitted with removably attached rolling casters. The casters permit the toolbox to be moved from one location to another.

Other attendant advantages of the present invention will be more readily apparent from the following detailed description and considered in connection with the accompanying drawings in which like reference numerals designate like parts throughout the figures.

BRIEF DESCRIPTION OF THE DRAWINGS

FIG. 3 is a side view of the first embodiment of the toolbox showing rolling casters on the bottom thereof;

FIG. 4 is a cross-sectional view of a second embodiment of the toolbox hereof showing the heating device mounted on the bottom surface of the drawers of the toolbox;

FIG. 5 is a cross-sectional view of a third embodiment of a toolbox in accordance herewith.

DESCRIPTION OF THE PREFERRED EMBODIMENT

Figure 1:
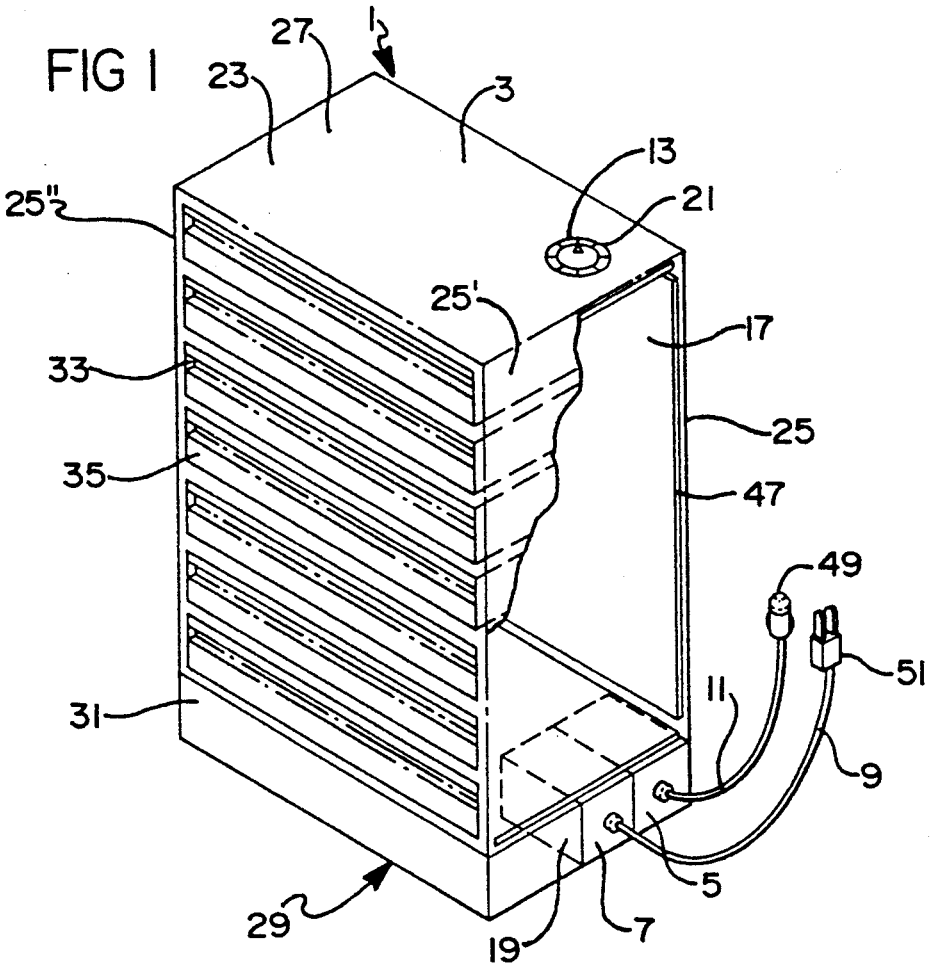
FIG. 1 is a perspective view of a first embodiment of a toolbox in accordance herewith.
Figure 2:
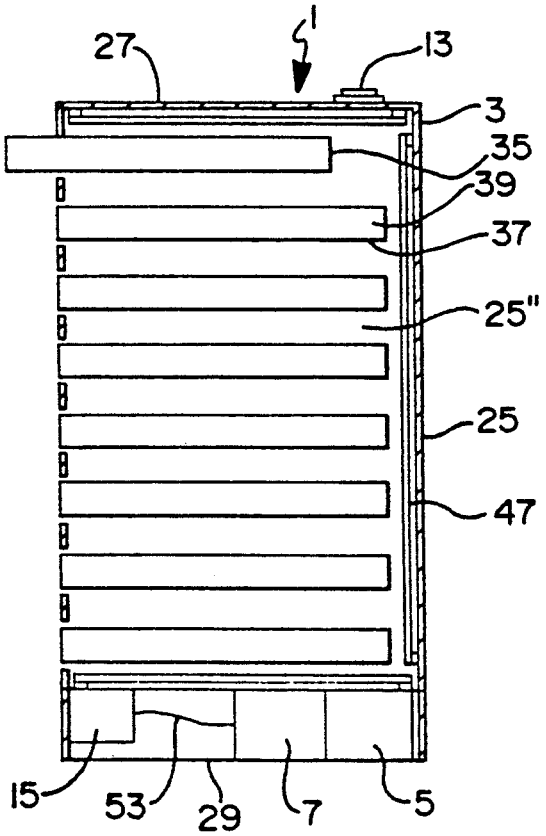
FIG. 2 is a cross-sectional view of the tool box showing the heating device mounted to the side walls of the toolbox.

Referring now to the drawings and to FIGS. 1, 2 and 3, there is depicted therein a first embodiment of the instant electrically heated toolbox 1. The toolbox 1, generally, comprises:

(a) a container 3; and (b) means 17 for electrically heating the inside environment such that at least one tool 4 disposed within the container 3 is heated to a predetermined temperature.

The container 3, generally, comprises: a cabinet 23 having at least two side walls 25, 25', a back wall 25'', a top wall 27 and a bottom wall 29, all integrally formed to define a unitary structure. The cabinet 23 also has front wall 31 integrally formed with the top wall 27, side walls 25, 25' and bottom wall 29. The front wall 31 having at least one elongated, horizontal aperture 33 formed therein for slidably receiving a tool containing drawer 35 or tray 35.

The drawer 35 has a base plate 37 and an integrally connected wall 39 attached thereto. Also, the drawer 35 has a front end 36, a rear end 38 and two sides 40, 40'. The rear end of the drawer is insertable into the aperture 33 formed in the front wall 31 of the cabinet 23. Means 41 for sliding the tool drawer 35 in and out of the aperture 33 in the front wall 31 of the cabinet 23 is disposed within the cabinet 23. The means 41 for sliding the tool drawer 35 comprises at least a pair of sliding brackets 43, 43' attached to each side 40, 40', respectively, of the tool drawer 35. The means 41 for a sliding also include at least one pair of sliding tracks 45, 45' one each of the sliding tracks is removably attachable to each side wall 25, 25' respectively of the tool cabinet 23. The sliding brackets 43, 43' and sliding tracks 45, 45' cooperate to permit the tool drawer 35 to freely slide in and out of the tool cabinet 23. The sliding brackets 43, 43' are slidingly insertable in to the sliding tracks 45, 45'.

The preferred means 17 for electrically heating the toolbox comprises:

(a) at least one heating sheet 47, the heating sheet 47 being removably attachable to the walls 25, 25', 25'', the top 27 and the bottom 29 of the tool container 23; and (b) a common electrical connecting bus 15 for connecting each of the heating sheets attached to the container walls 25, 25', 25'', the top 27 and bottom 29, the bus 15 being removably attachable to the cabinet 23.

The heating sheet 47 is a commercially available product supplied by Donnelly Corporation of Holland, Mich. The heating sheet 47 comprises of a glass or ceramic sheet or the like which is coated with indium tin oxide (ITO), a transparent conductive film, or similar type film. The transparent conductive film and the ceramic sheet are subsequently coated with a laminated polymer such as polyvinyl butylene to protect the conductive film.

Connected to the ITO coating is a small bus which is connected to a common bus 15 used to connect to a power source.

The ITO film receives a charge of electricity through the small bus which causes the film to generate heat, thereby heating the glass sheet. In turn, the heat from the glass sheet heats the environment of the tool container 3.

The electrically heated toolbox 1 can be provided with power to heat the heating sheets 47 from several different power sources (not shown). In this embodiment, a means 19 for connecting the heating sheets with the outside power source is provided and comprises:

(a) a voltage regulator 5 for adjusting the direct current (dc) provided by an outside dc power source to the heating sheets 47; and (b) an insulated electrical wire 11 removably connectable to the outside dc power source at one end and removably connected to the voltage regulator 5 at the other end.

(c) an electrical rectifier 7 which converts alternating current to the direct current used to operate the heating sheets 47; and (d) an insulated electrical wire 9 removably connected to the alternating current (AC) outside power source at one end and removably connected to an electrical rectifier 7 at the other end.

Connections to the outside power sources are AC or DC. A DC connector 61 may be clips (not shown) or other such connection types of devices which would connect to a DC power source such as an automobile battery (not shown) or a one prong plug used in a cigarette lighter of a vehicle connecting to a DC power source. The connection to the AC power source is a standard type two prong plug 63 which is commonly used for most electrical outlets. The power is transported either through the voltage regulator 5 or the rectifier 7 to the common bus 15 and then from the common bus 15 to the heating sheets 47. The connection between the voltage regulator 5 and bus 15 and the heating sheets 47 is standard insulated electrical wiring 53.

The temperature of the electrically heated toolbox 1 may be controlled by a means 21 for controlling and setting temperature which comprises a rheostat resistor 13 interconnected between the means 19 for connecting and means 17 for heating. The rheostat 13 has on-off settings or may have multiple temperature settings for adjusting the means 17 for heating.

In a second embodiment of the instant invention and as shown in FIG. 4, an electrically heated toolbox 61 similarly constructed to the first embodiment includes means 75 for electrically heating the tools disposed within the toolbox 61. The means 75 comprises:

(a) at least one heating sheet 69, the heating sheet 69 is removably attachable to a bottom surface 67 of a tool drawer 63 for directly heating the tools;

(b) a drawer connector or bus 71 for connecting the heating sheet 69 attached to the drawer, the drawer connector being removably attachable to the sliding drawer 63;

(c) a wall connector 73 for interconnecting with the drawer connector 71 when a drawer 63 is fully closed, the wall connector 73 removably attached to the back wall 25 of the tool cabinet 23; and (d) a common connecting bus 15 for connecting with each wall connector 73 attached to the wall 25 of the tool cabinet 23.

The present embodiment provides a direct heating for the tools, not the radiant heating of the first embodiment.

As shown in FIG. 3, the first embodiment of the electrically heated toolbox 1 includes the container 97 with means for rolling the container, the means being at least one removably attachable rolling caster 99 positioned on the bottom surface of the container 1. The casters 99 define a method for the toolbox 1 of any of the above embodiments to be moved to or positioned at any desirable location.

A third embodiment of the present invention, and as shown in FIG. 5 is an electrically heated toolbox 81 which includes a hinged top 83, a stationary top tool tray 89 and at least one removably insertable tool drawer 91 positioned underneath the stationary tool tray 81.

This embodiment of the electrically heated toolbox 81 may also include a detachable or a hinged front cover 85 pivotably attached to the bottom of the tool container 82 and positioned to cover the tool drawers 91 when the toolbox 81 is closed. The toolbox 81 can accommodate either the wall mounted heating sheets 47 for radiated heat or the drawer bottom surface mounted heating sheets 69 for direct heating the tools.

While the invention has been described in conjunction with specific embodiments, it is evident that many alternatives, modifications and variations will be apparent to those skilled in the art in light of the disclosure herein. It is intended that all such alternatives, modifications and variations are included herein that fall within the spirit and scope of the appended claims.

Having, thus, described the instant invention, what is claimed is:

1. An electrically heated toolbox comprising:

(a) a container for holding tools, the container comprising:

(1) a cabinet, the cabinet having a back wall, two side walls, a top wall, a bottom wall and a front wall, the front wall having at least one elongated aperture formed therein, the walls being interconnected, (2) at least one tool drawer for holding a tool, the at least one drawer having a bottom and a connected wall securely attached and normal to the bottom, the drawer being insertable within the aperture of the front wall; and (3) means for sliding the tool drawer in and out of the aperture in the front wall of the cabinet; and (b) means for electrically heating the tool box comprising:

(1) at least one heating sheet, the heating sheet removably attachable to the bottom surface of the tool drawer;

(2) a drawer electrical connector for electrically connecting the heating sheets attached to the drawer, the electrical connector removably attachable to the tool drawer;

(3) a wall electrical connector, the wall electrical connector electrically connecting with the drawer electrical connector when the drawer is in a fully closed position, the wall electrical connector being removably attachable to the wall of the tool cabinet;

(4) a connecting electrical bus for electrically connecting with the wall electrical connector attached to the wall of the tool cabinet; and (5) means for connecting the electrical bus to an outside power source.

2. The electrically heated toolbox of claim 1, wherein the means for electrically connecting the electrical bus with the power source comprises:

(a) a voltage regulator for regulating a direct current provided by an outside direct current power source to the means for heating; and (b) at least two insulated electrical wires removably connected to the outside direct current power source at one end and removably connected to the voltage regulator at the other end.

3. The electrically heated tool box of claim 1, wherein the means for electrically connecting the bus to an outside power source comprises:

(a) an electrical rectifier for converting alternating current electricity to direct current electricity, the direct current operating the means for electrically heating; and (b) at least two insulated electrical wires removably connected to the alternating current power source at one and removably connected to the electrical rectifier at the other end.

4. The electrically heated tool box of claim 1, which further comprises:

means for controlling and setting the temperature of the means for heating.

5. The electrically heated toolbox of claim 1, wherein the means for sliding the tool drawer in and out of the aperture comprises:

(a) at least one pair of sliding brackets, one each of the sliding brackets attached to a side of the tool drawer:

(b) at least one pair of sliding tracks, one each of the sliding tracks removably attached to a side wall of the container; and wherein the sliding brackets and sliding tracks cooperatively engage to define the means for sliding the drawers.

6. The electrically heated toolbox of claim 4, wherein the tool container comprises:

means for rolling the toolbox disposed on the bottom of the container.

7. The electrically heated tool box of claim 4, wherein the means for controlling the temperature comprises:

a rheostat resister interconnected between the means for connecting the bus and the means for heating.

* * * * *

UNITED STATES PATENT AND TRADEMARK OFFICE

CERTIFICATE OF CORRECTION

PATENT NO. : 5,276,310

DATED : January 4, 1994

INVENTOR(S) : William P. Schmidt and Kirk Malcomson

It is certified that error appears in the above-indentified patent and that said Letters Patent is hereby corrected as shown below:

Column 1, line 29: delete "and 5,816,646".
Column 2, line 19: replace "generates" with --generated--.
Column 3, line 5: delete "5".
Column 3, line 8: replace "25, 25'" with --25", 25"--; replace "25"" with --25--.
Column 3, line 12: replace "25, 25'" with --25', 25"--.
Column 3, line 18: delete ", 40"; delete "36"; delete "38".
Column 3, line 21: delete "41".
Column 3, line 23: delete "41".
Column 3, line 25: delete "43, 43'"; delete "40'".
Column 3, line 26: delete "41"; delete "a".
Column 3, line 27: delete "45, 45'".
Column 3, line 28: replace "is" with --being--.
Column 3, line 29: replace "25, 25'" with --25', 25"--.
Column 3, line 30: delete "43, 43'"; delete "45, 45'".
Column 3, line 32: delete "43,".
Column 3, line 33: delete "43'"; delete "45, 45'".
Column 3, line 38: before "27" insert --wall--; before "29" insert --wall--.
Column 3, line 41: before "27" insert --wall--; before "29" insert --wall--.
Column 4, line 13: replace "61" with --49--.
Column 4, line 19: replace "63" with --51--.
Column 4, line 51: delete "25".
Column 4, line 57: replace "97" with --3--.
Column 4, line 60: replace "1" with --3--.
Column 5, line 2: replace "81" with --89--.
Column 5, line 5: replace "bottom" with --back 82--.

UNITED STATES PATENT AND TRADEMARK OFFICE

CERTIFICATE OF CORRECTION

PATENT NO. : 5,276,310

DATED : January 4, 1994

INVENTOR(S) : William P. Schmidt, et. al.

It is certified that error appears in the above-indentified patent and that said Letters Patent is hereby corrected as shown below:

Column 5, line 6: delete "82".

Signed and Sealed this

Twenty-fourth Day of October, 1995

*Attest:*

Bruce Lehman

BRUCE LEHMAN

*Attesting Officer*

*Commissioner of Patents and Trademarks*